US007891431B2

(12) United States Patent
Freyer

(10) Patent No.: US 7,891,431 B2
(45) Date of Patent: Feb. 22, 2011

(54) ANNULAR PACKER DEVICE

(75) Inventor: Rune Freyer, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 194 days.

(21) Appl. No.: 11/912,926

(22) PCT Filed: Apr. 28, 2006

(86) PCT No.: PCT/NO2006/000160

§ 371 (c)(1),
(2), (4) Date: Aug. 15, 2008

(87) PCT Pub. No.: WO2006/118470

PCT Pub. Date: Nov. 9, 2006

(65) Prior Publication Data

US 2008/0308283 A1 Dec. 18, 2008

(30) Foreign Application Priority Data

May 2, 2005 (NO) ..... 20052144

(51) Int. Cl.
*E21B 33/12* (2006.01)

(52) U.S. Cl. ..... 166/387; 166/119; 166/180

(58) Field of Classification Search ..... 166/387, 166/180, 119

See application file for complete search history.

(56) References Cited

U.S. PATENT DOCUMENTS 2,232,325 A 2/1941 Hamilton
2,660,247 A * 11/1953 Sweet ..... 277/337
4,137,970 A * 2/1979 Laflin et al. ..... 166/292
4,329,916 A 5/1982 Roeder
4,345,649 A * 8/1982 Baugh et al. ..... 166/120
4,499,947 A * 2/1985 Zsoka et al. ..... 166/179
4,506,736 A * 3/1985 Evans ..... 166/387
4,595,052 A * 6/1986 Kristiansen ..... 166/123
5,195,583 A * 3/1993 Toon et al. ..... 166/187
5,467,822 A * 11/1995 Zwart ..... 166/179
6,220,351 B1 4/2001 Tovar De Pablos
6,286,603 B1 * 9/2001 Parent ..... 166/387

(Continued)

FOREIGN PATENT DOCUMENTS

CN 2186828 Y 1/1995

(Continued)

OTHER PUBLICATIONS

International Search Report issued for PCT/NO2006/000160 dated Aug. 25, 2006 (4 pages).

(Continued)

*Primary Examiner*—Jennifer H Gay
(74) *Attorney, Agent, or Firm*—Marlin R. Smith

(57) ABSTRACT

An annular packer device that is expandable in an annulus between an inner body and an outer boundary. The annular packer is sealingly movable along at least one of the inner body and the outer boundary. A method of sealing an annulus formed between a pipe and a borehole in a subterranean well can include positioning an annular packer sealingly around the pipe, expanding the packer into sealing engagement with the borehole, and permitting the pipe to displace relative to the packer while the packer remains sealingly engaged with the borehole.

20 Claims, 3 Drawing Sheets

U.S. PATENT DOCUMENTS

Figure 1:
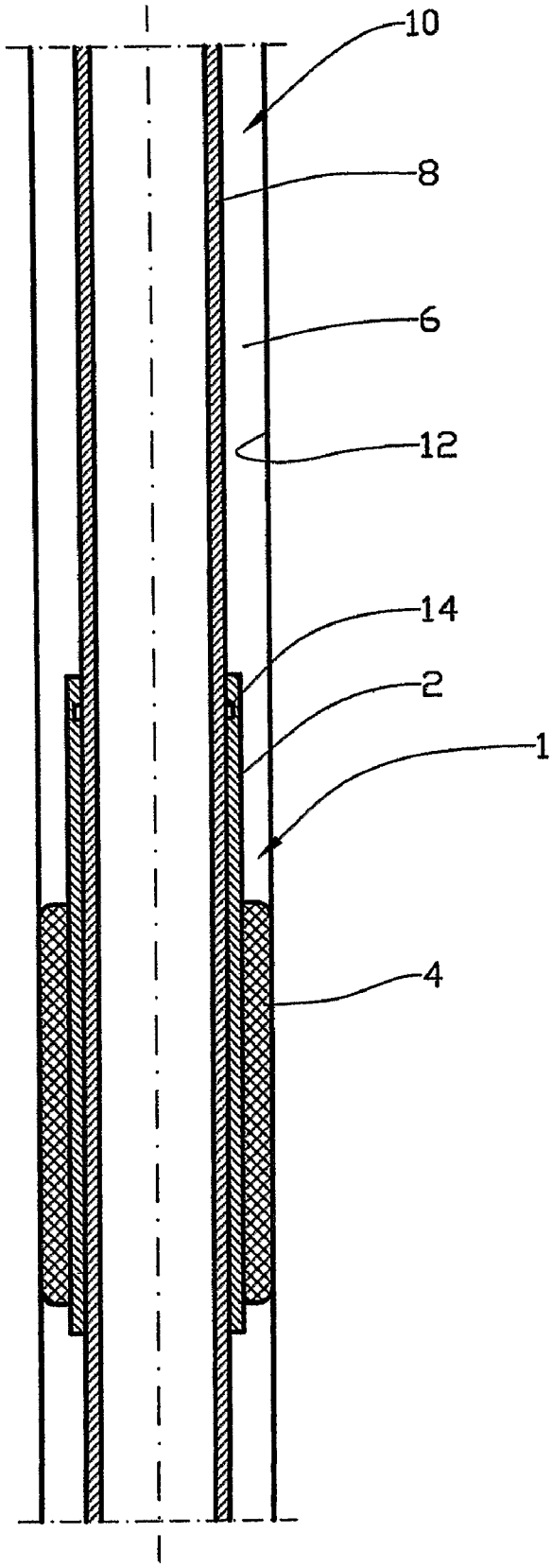

| | | | | |
|---|---|---|---|---|
| 6,988,557 | B2 * | 1/2006 | Whanger et al. | 166/380 |
| 7,143,832 | B2 * | 12/2006 | Freyer | 166/387 |
| 7,306,033 | B2 * | 12/2007 | Gorrara | 166/187 |
| 7,431,098 | B2 * | 10/2008 | Ohmer et al. | 166/387 |
| 2005/0072579 | A1 * | 4/2005 | Gambier | 166/387 |
| 2006/0027371 | A1 * | 2/2006 | Gorrara | 166/313 |
| 2006/0042801 | A1 * | 3/2006 | Hackworth et al. | 166/387 |
| 2007/0151723 | A1 * | 7/2007 | Freyer | 166/179 |
| 2008/0078561 | A1 * | 4/2008 | Chalker et al. | 166/387 |
| 2008/0185158 | A1 * | 8/2008 | Chalker et al. | 166/387 |
| 2009/0139707 | A1 * | 6/2009 | Berzin et al. | 166/118 |
| 2009/0229816 | A1 * | 9/2009 | Lemme et al. | 166/179 |
| 2009/0255675 | A1 * | 10/2009 | Casciaro | 166/292 |

FOREIGN PATENT DOCUMENTS

| | | | |
|---|---|---|---|
| GB | 2446399 | A * | 8/2008 |
| JP | 09151686 | A * | 6/1997 |
| JP | 2004162387 | A * | 6/2004 |

OTHER PUBLICATIONS

Chinese Office Action issued Oct. 12, 2010, for CN Patent Application No. 200680015217.3, 7 pages.

* cited by examiner

ANNULAR PACKER DEVICE

CROSS-REFERENCE TO RELATED APPLICATIONS

The present application is a national stage filing under 35 USC 371 of international application no. PCT/NO06/000160, filed 28 Apr. 2006, which claims priority to Norwegian application serial no. 20052144, filed 02 May 2005. The entire disclosures of these prior applications are incorporated herein by this reference.

This invention relates to an annular packer. More particularly it relates to an annular packer for use in a borehole, in which the annular packer is sealingly and movably connected to at least one of the bodies forming an annulus.

Expandable annular packers are used to a relatively great extent for different sealing and partitioning purposes in boreholes. It is common for the annular packer to be connected to a pipe, typically a production pipe or an injection pipe, which is run into the borehole, after which the annular packer is expanded against the formation wall or against a casing.

Annular packers may be pneumatically or hydraulically expandable, they may be swellable by means of a fluid or they may be expanded by means of fluid diffusion. If, after the annular packer has been set, operations are carried out, subjecting the pipe to temperature changes, considerable axial forces may arise in the pipe. An annular packer sealing against the formation wall, has a relatively loose anchoring to the formation wall and may, when being moved relative to the formation wall, lose its sealing effect.

According to the prior art, the pipe may be provided with an expansion coupling which is arranged to absorb an axial expansion or contraction in the pipe. Most commonly this expansion coupling is formed as a slip joint, in which a pipe body is sealingly movable within another pipe body.

Experience goes to show that couplings of this kind have several drawbacks. When expansions couplings are used, it may be difficult to determine whether the coupling is in the retracted position or the extended position. Thereby there may be the risk of over-extending the coupling, whereby a leak may arise in the coupling. If there is a rupture, adjacent equipment may also be overloaded, which may necessitate relatively extensive repair work.

The invention has as its object to remedy or reduce at least one of the drawbacks of the prior art.

The object is realized according to the invention through the features specified in the description below and in the following Claims.

The invention comprises an annular packer, the annular packer being expandable in an annulus between an inner body and an outer boundary. In addition, the annular packer is sealingly movable along at least one of the inner body and the outer boundary. Typically, the inner body is formed by a pipe extending over at least part of the depth of a borehole, whereas the outer boundary is formed by the formation wall of the borehole or a casing.

The expandable annular packer preferably comprises a sleeve encircled by an expandable material according to a technique known in itself. The expandable material is sealingly connected to the sleeve.

The sleeve encircling the pipe is movable along the pipe and provided with a seal which is arranged to prevent fluid from flowing between the pipe and the sleeve.

It is advantageous for at least part of the sleeve to be expandable in a radial direction in order further to supply pressure to the expandable material against the formation wall or against the casing.

The radial expansion of the sleeve, which may be elastic or plastic, may be effected mechanically or hydraulically in a manner known in it self.

In an alternative embodiment the annular packer may be formed without the mentioned sleeve, but with a reinforcement encircling the pipe. In this embodiment the annular packer is releasably movable on the pipe. In this embodiment also, the annular packer may be provided with a seal that is arranged to seal between the annular packer and the pipe.

Figure 2:
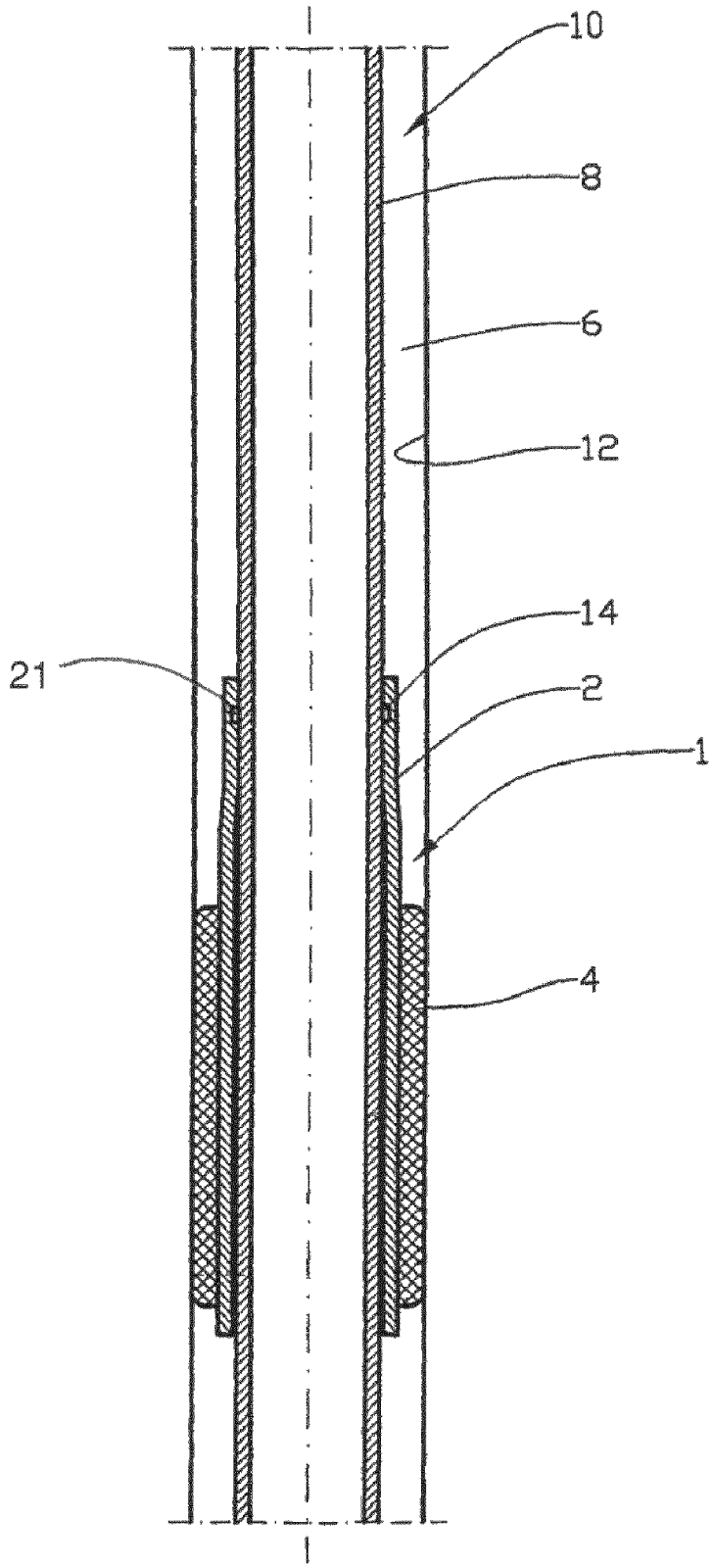
Figure 3:
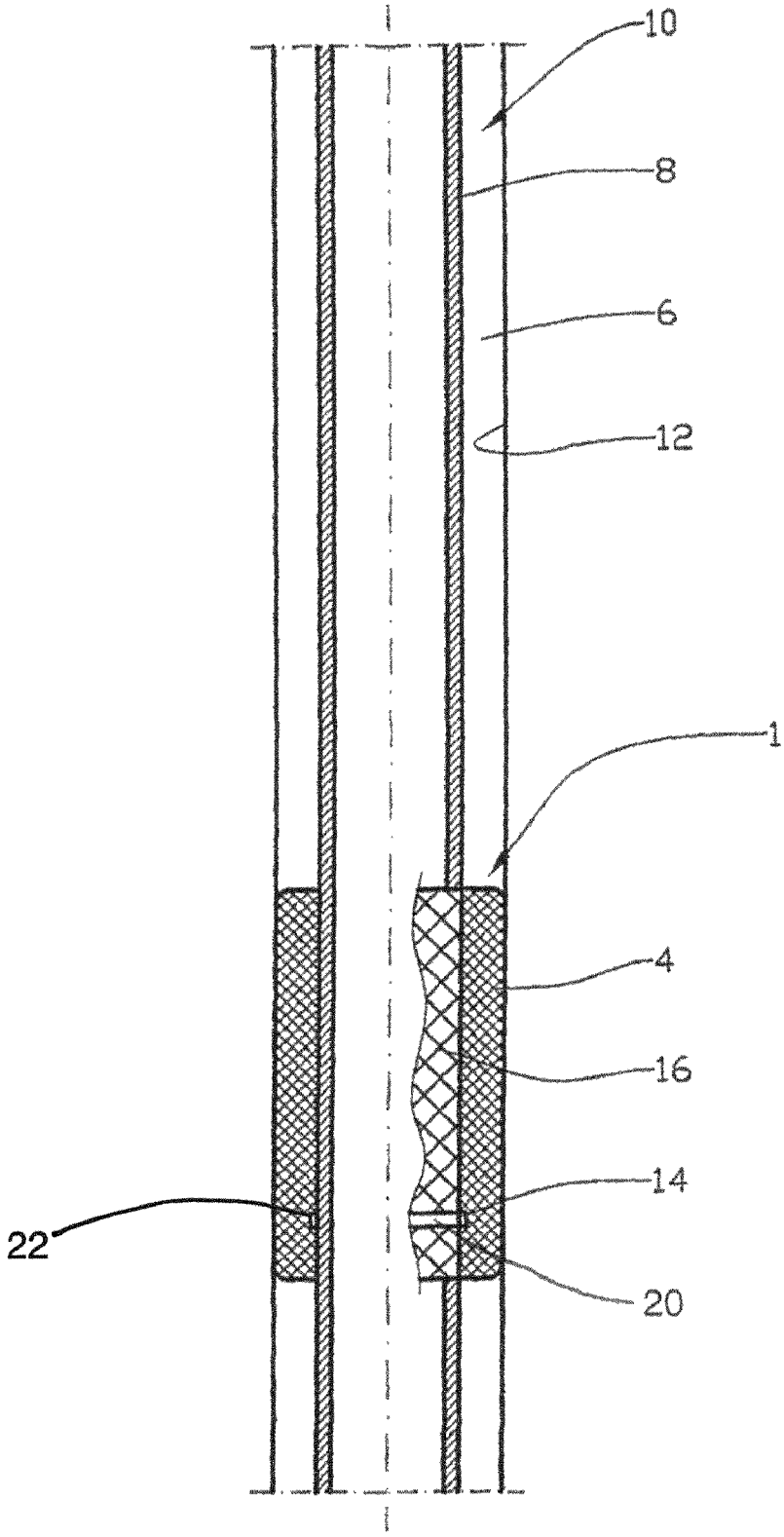

When an annular packer according to the invention is used, the pipe is relieved of axial forces caused by the attachment of an annular packer to the formation wall or a casing. The annular packer is therefore subjected to axial forces from the pipe only to an insignificant degree, thereby maintaining a reliable sealing in the annulus in question. In what follows there is described a non-limiting example of a preferred embodiment which is visualized in the accompanying drawings, in which:

FIG. 1 shows schematically an annular packer according to the invention, in which the annular packer has been set in a borehole, and in which the annular packer is sealingly movable along a pipe;

FIG. 2 shows the same as FIG. 1, but here the sleeve of the annular packer has been expanded in order further to supply radial pressure to the annular packer against the formation wall; and FIG. 3 shows an alternative embodiment of the annular packer of FIG. 1. In the drawings the reference numeral 1 identifies an expandable annular packer including a sleeve 2 and an expandable material 4 encircling and connected to the sleeve 2. In this preferred embodiment the expanding material 4 is formed by a swellable material, for example SBR (styrene/butadiene rubber).

The annular packer 1 is located in an annulus 6 defined by an inner body 8 in the form of a pipe and by an outer boundary 12 in the form of the formation wall of a borehole 10. The annular packer 1 has been expanded and bears sealingly on the formation wall 12.

The sleeve 2 movably encircles the pipe 8. A seal 14 prevents fluid from flowing between the sleeve 2 and the pipe 8. The seal 14 may be disposed in a complementary recess 21 in the sleeve 2 as shown in FIG. 2.

If a change should occur in the length of the pipe 8 due to, for example, heating or cooling, the pipe 8 may move in the annular packer 1 without the sealing of the annular packer 1 against the formation wall 12 being interrupted.

In an alternative embodiment, see FIG. 2, the sleeve 2 is expanded radially over part of its length in order further to supply a radial force to the expandable material 4 against the formation wall 12.

In a further embodiment the sleeve 2 has been replaced by a reinforcement 16 encircling the pipe 8. If desirable, in this embodiment the seal 14 may be placed between the expandable material 4 and the pipe 8. The seal 14 may be disposed in a circumferential slit 20 in the reinforcement 16 and a complementary recess 22 in the expandable material, as shown in FIG. 3. In this embodiment the annular packer 1 is preferably releasably movable on the pipe 8.

The invention claimed is:

1. A packer device for sealing an annulus defined by an outer surface of a pipe and an inner surface within a borehole, the packer device comprising:

an expandable material which provides sealing engagement with a portion of the inner surface when the packer device is set in the borehole; and a seal which provides slidable sealing engagement with the outer surface of the pipe, wherein the packer device permits relative movement of the pipe relative to the entire packer device while the packer device maintains sealing engagement with the inner and outer surfaces.

2. The packer device of claim 1, wherein the expandable material is sealingly connected to a sleeve encircling the pipe.

3. The packer device of claim 2, wherein the seal is arranged between the sleeve and the pipe, whereby fluid flow between the pipe and the sleeve is substantially prevented.

4. The packer device of claim 3, wherein the seal is disposed in a complementary recess in the sleeve and encircles the pipe.

5. The packer device of claim 2, wherein at least a part of the sleeve is expanded in a radial direction.

6. The packer device of claim 1, wherein the expandable material is sealingly connected to a reinforcement material encircling the pipe.

7. The packer device of claim 6, wherein the reinforcement material comprises a circumferential slit adapted for a seal arranged between the expandable material and the pipe, whereby fluid flow between the pipe and the expandable material is substantially prevented.

8. The packer device of claim 7, wherein the seal is disposed in a complementary recess in the expandable material and encircles the pipe.

9. The packer device of claim 1, wherein the inner surface comprises one of a formation wall of the borehole and an inside surface of a casing.

10. The packer device of claim 1, wherein the relative movement between the packer device and the pipe is caused by at least one of axial expansion and axial contraction of the pipe.

11. A system for relieving axial forces in a borehole, the system comprising:

a pipe which conveys fluid longitudinally through the borehole; and an annular packer, the packer including a swellable seal material, wherein the entire annular packer is sealingly movable along an outer surface of the pipe while substantially retaining the packer's axial position relative to an inner surface of the borehole when the swellable material is in sealing engagement with the inner surface.

12. The system of claim 11, further comprising a sleeve positioned radially between the packer and the pipe, the packer being secured against displacement relative to the sleeve, and the sleeve being sealingly and slidably engaged with the pipe.

13. The system of claim 12, wherein a portion of the sleeve underlying the packer is radially outwardly expandable while the sleeve remains sealingly engaged with the pipe.

14. The system of claim 11, wherein the packer further comprises a reinforcement which encircles the pipe.

15. The system of claim 11, further comprising a seal positioned between the packer and the pipe.

16. A method of sealing an annulus formed between a pipe and a borehole in a subterranean well, the method comprising the steps of:

positioning an annular packer device slidably and sealingly around the pipe which conveys fluid longitudinally through the borehole;

expanding the packer device into sealing engagement with the borehole; and then permitting the pipe to displace relative to the entire packer device while the packer device remains sealingly engaged with the borehole and the pipe.

17. The method of claim 16, wherein the expanding step further comprises swelling a seal material of the packer device.

18. The method of claim 16, wherein the positioning step further comprises attaching the packer device to a sleeve, and slidably and sealingly engaging the sleeve with the pipe.

19. The method of claim 18, further comprising the step of radially outwardly expanding a portion of the sleeve underlying the packer device while the sleeve remains sealingly engaged with the pipe.

20. The method of claim 16, wherein the positioning step further comprises providing the packer device with a reinforcement, and providing a seal between the packer device and the pipe.

* * * * *